US005941202A

United States Patent [19]

Jung

[11] Patent Number: 5,941,202

[45] Date of Patent: Aug. 24, 1999

[54] DEVICE FOR VARYING VALVE TIMING

[75] Inventor: Inhwa Jung, Inchon, Rep. of Korea

[73] Assignee: Hyundai Motor Company, Seoul, Rep. of Korea

[21] Appl. No.: 08/960,223

[22] Filed: Oct. 29, 1997

Related U.S. Application Data

[63] Continuation-in-part of application No. 08/550,943, Oct. 31, 1995, abandoned.

[30] Foreign Application Priority Data

Nov. 1, 1994 [KR] Rep. of Korea ..... 94-28509

[51] Int. Cl.[6] ..... F01L 1/344; F01L 13/00

[52] U.S. Cl. ..... 123/90.17; 123/90.31

[58] Field of Search ..... 123/90.15, 90.17, 123/90.31, 198 F; 74/568 R; 464/1, 2, 160

[56] References Cited

U.S. PATENT DOCUMENTS

| | | | |
|---|---|---|---|
| 3,978,829 | 9/1976 | Takahashi et al. | 123/90.17 |
| 4,967,701 | 11/1990 | Isogai et al. | 123/90.17 |
| 5,031,585 | 7/1991 | Muir et al. | 123/90.17 |
| 5,261,360 | 11/1993 | Voll et al. | 123/90.17 |
| 5,271,360 | 12/1993 | Kano et al. | 123/90.17 |
| 5,305,719 | 4/1994 | Clarke et al. | 123/90.17 |
| 5,435,782 | 7/1995 | Tortul | 123/90.17 |

*Primary Examiner*—Weilun Lo

*Attorney, Agent, or Firm*—Finnegan, Henderson, Farabow, Garrett & Dunner, L.L.P.

[57] ABSTRACT

Disclosed is a device for varying valve timing and engaging a cam shaft, in particular for a V-type engine. The device includes a cam shaft on which cams are mounted, a cam shaft pulley for transmitting power from a crank shaft to the cam shaft, a plate for placing the cam shaft pulley in engagement with the cam shaft, and an electromagnet mounted on the cam shaft pulley, the electromagnet being selectively engaged with the plate when electric power is applied thereto. First and second locking pins are provided in the cam shaft for engaging the plate. The locking pins are arranged in relatively eccentric positions and have different radial positions. The engagement between the plate and the cam shaft is achieved selectively by engaging one of the locking pins with the plate. Structure is provided for controlling movement of the locking pins to engage the locking pins with the plate selectively and for applying electric power to the electromagnet according to driving conditions of a vehicle.

8 Claims, 2 Drawing Sheets

DEVICE FOR VARYING VALVE TIMING

This application is a continuation in part of U.S. patent application Ser. No. 08/550,943, filed on Oct. 31, 1995 now abandoned.

BACKGROUND OF THE INVENTION

1. Field of the Invention

The present invention relates to a device for varying valve timing of an internal combustion engine. More specifically, the present invention relates to a device capable of varying valve timing by properly changing phase of a cam shaft and pausing the cam shaft according to traveling conditions, in particular for V-type engines.

2. Description of Related Art

An internal combustion engine, such as a vehicle engine, should regulate valve timing properly to produce maximum engine power. Many different types of devices are capable of regulating valve timing. Some of these devices change cam phase of a cam shaft to regulate valve timing. In one type of device, a helical gear places a cam shaft pulley in engagement with the cam shaft. In another type of device, structure is provided for moving a cam shaft sprocket to place the sprocket in engagement with the cam shaft. However, some of these devices have limited durability and/ or high manufacturing costs.

In light of the foregoing, there is a need in the art for an improved device for varying valve timing.

SUMMARY OF THE INVENTION

Accordingly, the present invention is directed to a device that substantially obviates one or more of the limitations of the related art. To achieve these and other advantages and in accordance with the purpose of the invention, as embodied and broadly described herein, the invention includes a device for varying valve timing, comprising a cam shaft on which cams are mounted and a cam shaft pulley for transmitting rotational motion from a crank shaft to the cam shaft. A plate is coupled to the cam shaft pulley. First and second locking pins are provided in the cam shaft for engaging the plate. The locking pins are eccentric and are located at different radial positions with respect to a rotational axis of the cam shaft so that the cam shaft pulley and the cam shaft are placed in different relative angular orientations based on selective engagement of one of the locking pins with the plate. In addition, a controller is provided for controlling movement of the locking pins to engage the locking pins selectively with the plate according to driving conditions of a vehicle.

In another aspect, the device also includes an electromagnet mounted on the cam shaft pulley. The electromagnet being is coupled selectively to the plate when electric power is supplied thereto. The controller supplies electric power to the electromagnet according to driving conditions of a vehicle.

In yet another aspect, the present invention includes a device for placing a cam shaft pulley in engagement with a cam shaft by means of a pair of locking pins. The locking pins are eccentric about an axis of rotation of the cam shaft and each of the locking pins is located at a different radial distance from the cam shaft's rotational axis. Cam phase adjustment for varying valve timing is controlled by selectively coupling one of the locking pins to the cam shaft pulley.

In a further aspect, the present invention provides a device allowing the cam shaft to be coupled with the cam shaft pulley selectively by means of an electromagnet. The electromagnet allows for coupling and decoupling of the cam shaft pulley and cam shaft depending on whether or not electric power is supplied to the electromagnet. In this way, the invention can pause the cam shaft, in particular when the cam shaft is in one side bank of a V-type engine.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention and are incorporated in and constitute a part of this specification. The drawings illustrate an embodiment of the invention and, together with the description, serve to explain the principles of the invention. In the drawings.

DESCRIPTION OF THE PREFERRED EMBODIMENT

Figure 1:
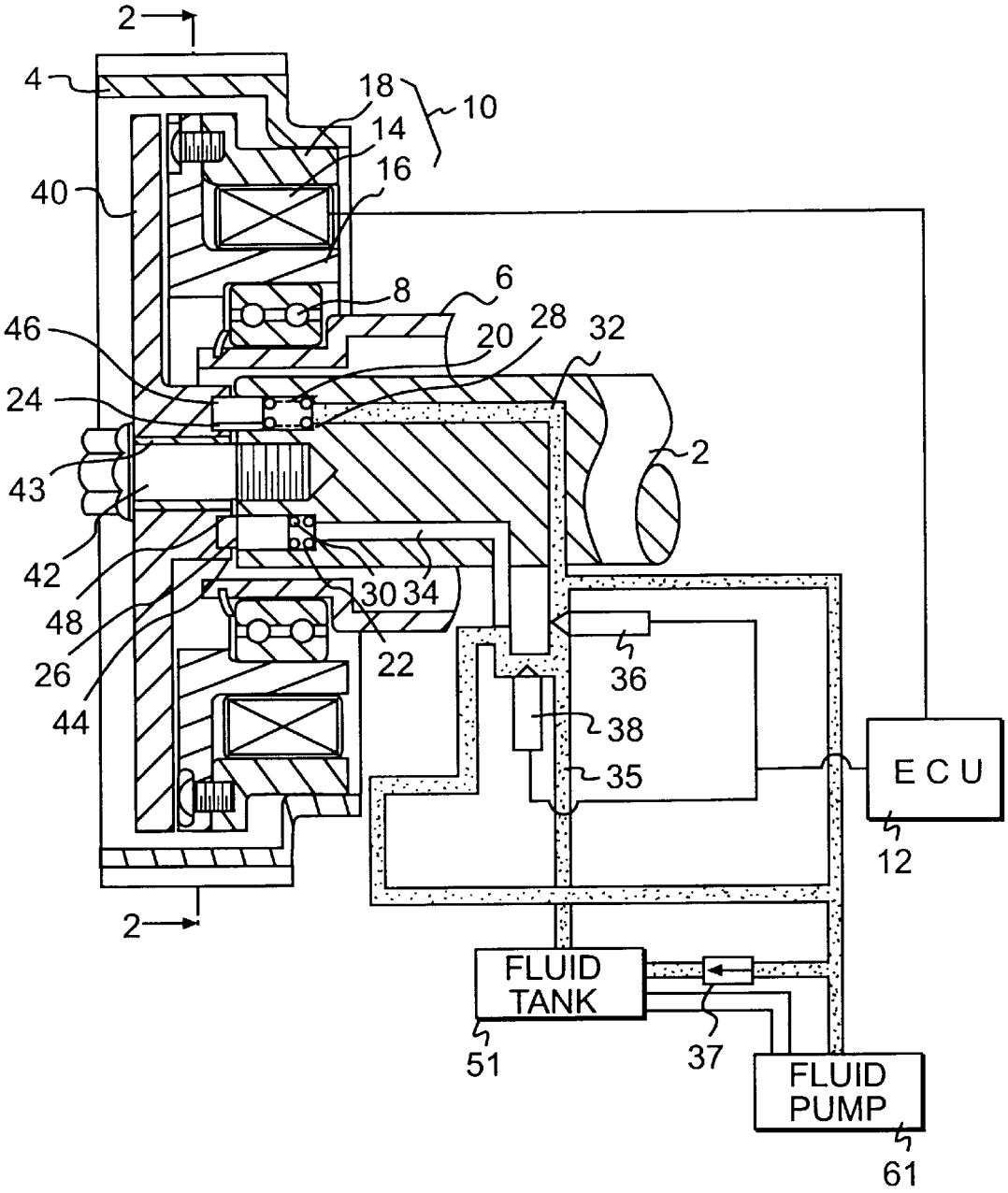
FIG. 1 is a partially schematic cross-sectional view of a valve timing device in accordance with the preferred embodiment of the invention.

Reference will now be made in detail to a preferred embodiment of the invention, an example of which is illustrated in the accompanying drawings. Wherever possible, the same reference numbers are used in the drawings and the description to refer to the same or like parts.

FIG. 1 shows a cam shaft 2 and a pulley 4. Preferably, the pulley 4 is engaged with an engine crank shaft (not shown) by means of a chain or belt (not shown). The pulley 4 is mounted on an outer side of a magnetic coil assembly 10, and the cam shaft 2 is supported by a cam shaft housing 6. A bearing 8 is arranged between the magnetic coil assembly 10 and the cam shaft housing 6 to allow for rotation of the pulley 4 and the cam shaft 2 with respect to one another.

The magnetic coil assembly 10 includes a magnetic coil 14 and cases 16 and 18 providing a casing for the magnetic coil 14. Electric energy is supplied to the magnetic coil 14 by an electronic control unit (ECU) 12.

As shown in FIG. 1, magnetic plate 40 is coupled to the cam shaft 2 by means of a bolt 42 attached to the front of the cam shaft 2. A bushing 43 is provided around the bolt 42 so that the magnetic plate 40 is capable of rotating with respect to the bolt 42 and cam shaft 2. The magnetic plate 40 is coupled with the magnetic coil assembly 10 depending upon whether electric energy is applied to the magnetic coil assembly 10. In other words, when electric energy is applied to the magnetic coil assembly 10 by the ECU 12, a magnetic field is formed which couples the plate 40 to the magnetic coil assembly 10 and, as a result, the magnetic plate 40 is coupled to the pulley 4 through the magnetic coil assembly 10. A rear face of the magnetic plate 40 includes first and second locking holes 46 and 48 formed therein.

Figure 2:
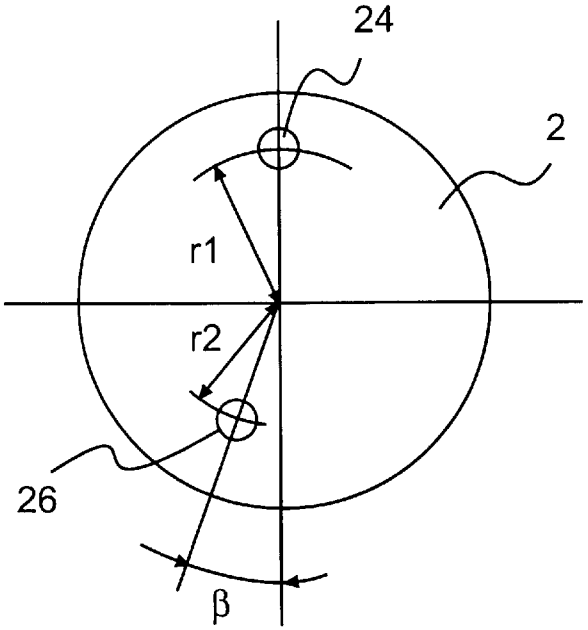
FIG. 2 is a partially schematic view taken along line 2—2 in FIG. 1 of a front face of cam shaft for the device.

First and second cylinders 20 and 22 are provided in the cam shaft 2 at its leading end. As shown in FIG. 2, radiuses r1 and r2 of the cylinders 20 and 22 from the rotational axis of the cam shaft 2 are different, and the second cylinder 22 is positioned eccentrically with respect to the first cylinder 20 by a predetermined number of degrees β about the cam shaft rotational axis. This position of the second cylinder 22 allows a cam phase change according to the eccentric angle β.

As shown in FIG. 1, first and second locking pins 24 and 26 are provided in the first and second cylinders 20 and 22 for selective engagement with the first and second locking holes 46 and 48, respectively. The locking pins 24 and 26 are connected to elastic members 28 and 30, respectively. The elastic members 28 and 30 respectively bias the first and second locking pins 24 and 26 in the cylinders 20 and 22 away from a magnetic plate 40.

Figure 3:
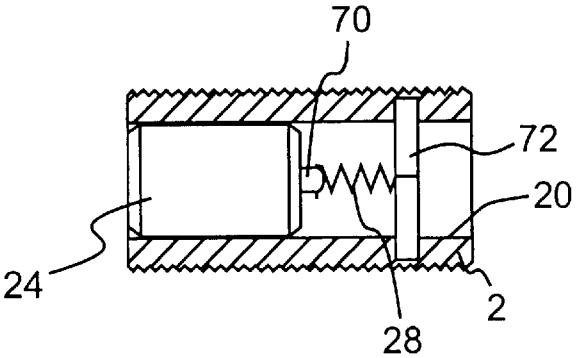
FIG. 3 is a view showing a retracted condition of a locking pin and spring shown in FIG. 1.
Figure 4:
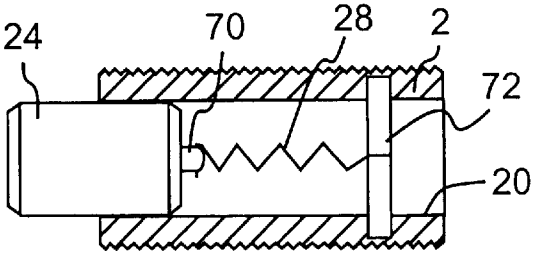
FIG. 4 is a view similar to FIG. 3 showing an extended condition of the locking pin and spring.

As shown in FIGS. 3 and 4, the elastic member 28 has a first end connected to a spring seat 70 on the locking pin 24 and a second end connected to a pin 72 fixed to the cam shaft 2. In an at rest condition, the elastic member 28 biases the locking pin 24 in the cylinder 20, as shown in FIG. 3. When hydraulic pressure of fluid in the cylinder 20 (explained below) exceeds the biasing force of the elastic member 24, the locking pin 24 extends from the cylinder 20, as shown in FIG. 4. In the position shown in FIG. 4, the locking pin 24 engages the locking hole 46, shown in FIG. 1. As this hydraulic pressure decreases, the elastic member 28 biases the locking pin 24 back in the cylinder 24, as shown in FIG. 3, so that the locking pin 24 is out of engagement with the hole 46.

Although the specific details are not shown in the drawings, the elastic member 30 is connected to the locking pin 26 and cam shaft 2 in the same way the elastic member 28 is connected to the locking pin 24 and cam shaft 2. In addition, the elastic member 30 and locking pin 26 function like the elastic member 28 and locking pin 24, and the locking pin 26 engages the locking hole 48 in the same way the locking pin 26 engages the locking hole 46.

Preferably, the ECU 12 controls both the engagement of the locking pins 24 and 26 in locking holes 46 and 48 and the coupling of electromagnetic coil and magnetic plate 40 so that the cam shaft 2 and crank shaft (not shown) are synchronized properly. For example, the ECU 12 optionally receives information from rotational position sensors (not shown) for monitoring the rotational position of the cam shaft 2 and crank shaft.

As shown in FIG. 1, the cylinders 20 and 22 communicate with first and second passages 32 and 34 provided in the camshaft 2. The first and second passages 32 and 34 include first and second solenoid valves 36 and 38, respectively, which are controlled by the ECU 12.

A fluid pump 61 pumps hydraulic fluid from a hydraulic fluid source 51 to the passages 32 and 34 according to the operation of the valves 36 and 38. When the ECU 12 places the first valve 36 in a closed position, the pump 61 increases pressure of fluid in passage 32 to overcome the biasing force of elastic member 28 and thereby force the locking pin 24 out of the cylinder 20 to engage the locking hole 46 in the plate 40. While the first valve 36 is in the closed position, the ECU places the second valve 38 in an open position. This allows hydraulic fluid to flow to the fluid tank 51 via a drain passage 51, rather than increasing pressure in the cylinder 22 enough to overcome the biasing force of elastic member 30.

When the ECU 12 places the second valve 38 in a closed position, pump 61 increases the pressure of fluid in passage 34 to overcome the biasing force of elastic member 30 and thereby force the locking pin 26 out of the cylinder 20 to engage the locking hole 48 in the plate 40. While the second valve 38 is in the closed position, the ECU places the first valve 36 in an open position. This allows hydraulic fluid to flow to the fluid tank 51 via the drain passage 51, rather than increasing pressure in the cylinder 20 enough to overcome the biasing force of elastic member 28.

Preferably, the ECU 12 controls both the engagement of the locking pins 24 and 26 in locking holes 46 and 48 and the coupling of electromagnetic coil and magnetic plate 40 so that the cam shaft 2 and crank shaft (not shown) are synchronized properly. For example, the ECU 12 optionally receives information from rotational position sensors (not shown) for monitoring the rotational position of the cam shaft 2 and crank shaft.

As shown in FIG. 1, a relief valve 37 is provided to permit direct one way flow from the pump 61 to the source 51 when the hydraulic pressure produced by the pump 61 exceeds a predetermined value.

The above described embodiment operates as described below.

During high speed or high load, the ECU 12 forms the magnetic field in the magnetic coil assembly 10 by applying electric energy to the magnetic coil assembly 10 so that the plate 40 is coupled magnetically to the pulley 4. Then, the ECU 12 opens the first valve 36 and closes the second valve 38 to increase hydraulic pressure in the first cylinder 20. The first locking pin 24 is pushed into the first hole 46 and, as a result, rotational motion is transferred to the cam shaft 2 through the pulley 4, the plate 40, and the first locking pin 24 to rotate the cam shaft 2.

In this position, if the vehicle speed is increased and there is a need to vary valve timing, the ECU 12 operates the first and second solenoid valves 36 and 38 to close the first solenoid valve 36 and to open the second solenoid valve 38. Then, the first locking pin 24 is released from the first locking hole 46 by the biasing of the elastic member-28 and the second locking pin 26 is pushed in the second locking hole 48. As a result, the cam shaft 2 is engaged with the plate 40 through the second locking pin 26. Since the second cylinder 22 is eccentrically positioned by β degrees with respect to the first cylinder 20, the engagement between the plate 40 and the cam shaft 2 through the second locking hole 48 and the second locking pin 26 results in the cam phase being changed by β degrees to change valve timing.

During conditions such as when the device is used with a V-type engine, and when the speed or load is low, the ECU 12 does not apply electric energy to the magnetic coil 14. This allows the pulley 4 to rotate with respect to both the magnetic plate 40 and cam shaft 2. Therefore, this embodiment can pause the cam shaft in one bank side of a V-type engine.

As described above, the invention provides a device capable of producing high torque in a low speed range or a middle speed range and also increasing power in a high speed range.

Also, the invention provides a device capable of pausing a cam shaft in one bank side of a V-type engine.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A device for varying valve timing, comprising:

a cam shaft on which cams are mounted;

a cam shaft pulley for transmitting rotational motion from a crank shaft to the cam shaft;

a plate coupled to the cam shaft pulley;

first and second locking pins in the cam shaft for engaging the plate, the locking pins being eccentric and being located at different radial positions with respect to a rotational axis of the cam shaft so that the cam shaft pulley and the cam shaft are placed in different relative angular orientations based on selective engagement of one of the locking pins with the plate; and a controller for controlling movement of the locking pins to engage the locking pins selectively with the plate according to driving conditions of a vehicle.

2. The device of claim 1, further comprising locking holes formed in the plate and biasing members coupled to the locking pins, the locking pins being capable of engaging the locking holes and the biasing members being capable of biasing the locking pins out of engagement with the locking holes.

3. The device of claim 1, wherein the first locking pin is in a first cylindrical hole formed in the cam shaft and the second locking pin is in a second cylindrical hole formed in the cam shaft, and wherein the controller includes first and second passages respectively placing the first and second cylindrical holes in communication with a hydraulic fluid supply, first and second solenoid valves for respectively regulating flow of hydraulic fluid through the first and second passages, and an electronic control unit for controlling opening and closing of the solenoid valves selectively according to the driving conditions.

4. The device of claim 2, wherein the first locking pin is in a first cylindrical hole formed in the cam shaft and the second locking pin is in a second cylindrical hole formed in the cam shaft, and wherein the controller includes first and second passages respectively placing the first and second cylindrical holes in communication with a hydraulic fluid supply, first and second solenoid valves for respectively regulating flow of hydraulic fluid through the first and second passages, and an electronic control unit for controlling opening and closing of the solenoid valves selectively according to the driving conditions.

5. A device for varying valve timing and for selectively engaging a camshaft, comprising:

a cam shaft on which cams are mounted;

a cam shaft pulley for transmitting rotational motion from a crank shaft to the cam shaft;

a plate for placing the cam shaft pulley in engagement with the cam shaft;

an electromagnet mounted on the cam shaft pulley, the electromagnet being selectively coupled to the plate when electric power is supplied thereto;

first and second locking pins in the cam shaft for engaging the plate, the locking pins being eccentric and being located at different radial positions with respect to an axis of the cam shaft so that the cam shaft and the cam shaft pulley are placed in different relative angular orientations based on selective engagement of one of the locking pins with the plate; and a controller for controlling selective engagement of the locking pins with the plate and for supplying electric power to the electromagnet according to driving conditions of a vehicle.

6. The device of claim 5, further comprising locking holes formed in the plate and biasing members coupled to the locking pins, the locking pins being capable of engaging the locking holes and the biasing members being capable of biasing the locking pins out of engagement with the locking holes.

7. The device of claim 5, wherein the first locking pin is in a first cylindrical hole formed in the cam shaft and the second locking pin is in a second cylindrical hole formed in the cam shaft, and wherein the controller includes first and second passages respectively placing the first and second cylindrical holes in communication with a hydraulic fluid supply, first and second solenoid valves for respectively regulating flow of hydraulic fluid through the first and second passages, and an electronic control unit for controlling opening and closing of the solenoid valves selectively according to the driving conditions.

8. The device of claim 6, wherein the first locking pin is in a first cylindrical hole formed in the cam shaft and the second locking pin is in a second cylindrical hole formed in the cam shaft, and wherein the controller includes first and second passages respectively placing the first and second cylindrical holes in communication with a hydraulic fluid supply, first and second solenoid valves for respectively regulating flow of hydraulic fluid through the first and second passages, and an electronic control unit for controlling opening and closing of the solenoid valves selectively according to the driving conditions.

* * * * *